US009366436B2

(12) United States Patent
Clemen et al.

(10) Patent No.: US 9,366,436 B2
(45) Date of Patent: Jun. 14, 2016

(54) COMBUSTION CHAMBER OF A GAS TURBINE

(71) Applicant: Rolls-Royce Deutschland Ltd & Co KG, Blankenfelde-Mahlow (DE)

(72) Inventors: Carsten Clemen, Mittenwalde (DE); Thomas Doerr, Berlin (DE); Sebastian Bake, Berlin (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 0 days.

(21) Appl. No.: 14/643,443

(22) Filed: Mar. 10, 2015

(65) Prior Publication Data

US 2015/0260403 A1 Sep. 17, 2015

(30) Foreign Application Priority Data

Mar. 11, 2014 (DE) ..... 10 2014 204 482

(51) Int. Cl.

| | |
|---|---|
| ***F23R 3/00*** | (2006.01) |
| ***F23R 3/02*** | (2006.01) |
| ***F23R 3/06*** | (2006.01) |
| ***F23R 3/60*** | (2006.01) |

(52) U.S. Cl.
CPC . *F23R 3/002* (2013.01); *F23R 3/02* (2013.01); *F23R 3/06* (2013.01); *F23R 3/60* (2013.01)

(58) Field of Classification Search
CPC ..... F23R 3/06; F23R 3/08; F23R 3/002; F23R 3/04
See application file for complete search history.

(56) References Cited

U.S. PATENT DOCUMENTS

| | | | | |
|---|---|---|---|---|
| 2,699,648 | A * | 1/1955 | Berkey | F23R 3/08 431/352 |
| 4,085,579 | A | 4/1978 | Holzapfel et al. | |
| 4,138,842 | A | 2/1979 | Zwick | |
| 4,430,860 | A | 2/1984 | Melchior et al. | |
| 4,567,730 | A * | 2/1986 | Scott | F23R 3/007 60/752 |
| 4,773,227 | A | 9/1988 | Chabis | |
| 5,461,866 | A * | 10/1995 | Sullivan | F23R 3/08 60/757 |
| 7,263,833 | B2 | 9/2007 | Sanders | |
| 7,788,928 | B2 * | 9/2010 | De Sousa | F23R 3/002 60/753 |

(Continued)

FOREIGN PATENT DOCUMENTS

| | | |
|---|---|---|
| DE | 1179422 | 10/1964 |
| DE | 1815695 | 8/1970 |
| DE | 2416909 | 10/1975 |

(Continued)

OTHER PUBLICATIONS

German Search Report dated Mar. 31, 2014 for counterpart app. No. 10 2014 204 482.0.

(Continued)

*Primary Examiner* — Phutthiwat Wongwian
*Assistant Examiner* — Stefan Ibroni
(74) *Attorney, Agent, or Firm* — Timothy J. Klima; Shuttleworth & Ingersoll, PLC

(57) ABSTRACT

A combustion chamber of a gas turbine with an outer combustion chamber wall and with tiles attached to the inner side of said wall or to a combustion chamber of the single-wall design, wherein the combustion chamber has in a center area, relative to the flow direction, a slot extending around the circumference of the combustion chamber and dividing the outer combustion chamber wall and the tiles for the supply of mixing air.

8 Claims, 8 Drawing Sheets

(56) References Cited

U.S. PATENT DOCUMENTS

Figure 1:
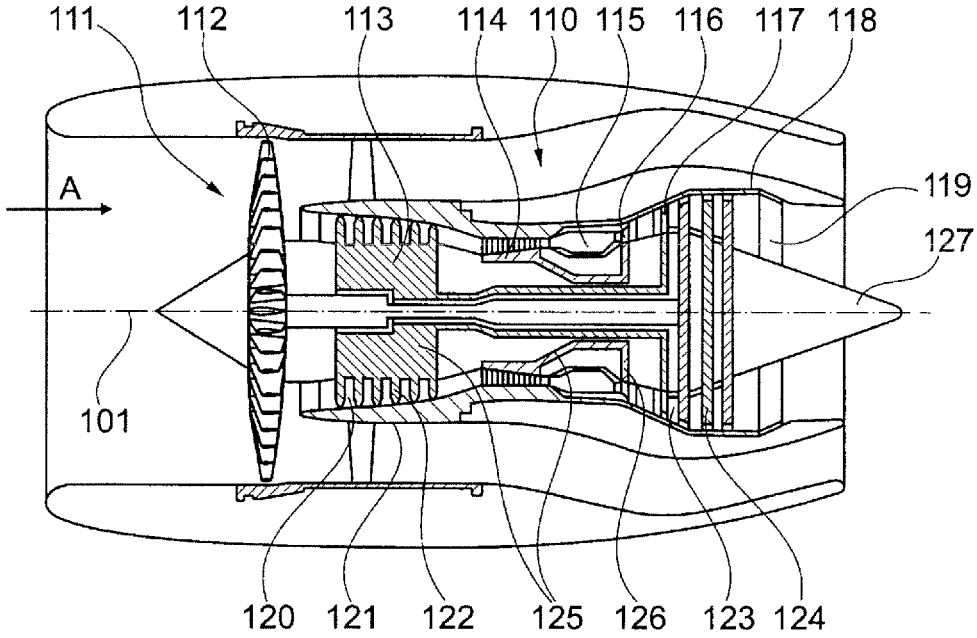

| | | | |
|---|---|---|---|
| 2010/0126174 | A1 | 5/2010 | Brinkmann et al. |
| 2011/0173984 | A1 | 7/2011 | Valeev et al. |

FOREIGN PATENT DOCUMENTS

| | | | |
|---|---|---|---|
| DE | 3209135 | | 9/1983 |
| DE | 4034711 | | 2/1992 |
| DE | 102006042124 | | 3/2008 |
| DE | 102006048842 | | 4/2008 |
| FR | 1036218 | | 9/1953 |
| GB | 543918 | A | 3/1942 |
| GB | 1256066 | | 12/1971 |

OTHER PUBLICATIONS

European Search Report dated Aug. 21, 2015 for related European Patent Application No. 15158442.2.
European Search Report dated Jan. 15, 2016 for related European Patent Application No. 15158442.2.

* cited by examiner

State of the art

COMBUSTION CHAMBER OF A GAS TURBINE

This application claims priority to German Patent Application DE102014204482.0 filed Mar. 11, 2014, the entirety of which is incorporated by reference herein.

This invention relates to a combustion chamber of a gas turbine with an outer combustion chamber wall and with tiles attached to the inner side of the outer combustion chamber wall.

It is known from the state of the art to introduce air into the combustion chamber interior radially from the outside through admixing holes or mixing air holes. Individual and discrete admixing holes, which are suitably distributed over the circumference of the combustion chamber, are always used here. The admixing holes are here usually arranged in one or several rows on the circumference of the combustion chamber.

The supply of mixing air is used to optimize combustion in the combustion chamber. In particular, a best possible blocking and mixing of the combustion gases with the admixing air should be achieved in order to control and minimize the NOx emissions.

The designs known from the state of the art have the disadvantage that maximum blocking and optimum mixing of the admixing air with the combustion gases is not possible due to the discrete and individual arrangement of the admixing holes. Hence the maximum possible reduction of NOx emissions is not possible. It has proven to be a further disadvantage of the known designs that an arbitrary arrangement of the individual, discrete admixing holes relative to one another and in particular an arbitrary spacing of the admixing holes relative to one another are not possible due to the mechanical structure of the combustion chamber outer wall and the tile.

The object underlying the present invention is to provide a combustion chamber of a gas turbine, which while being simply designed and easily and cost-effectively producible avoids the disadvantages of the state of the art and enables an optimized supply of mixing air.

It is a particular object of the present invention to provide solution to the above problematics by the combination of the features of Claim 1. Further advantageous embodiments of the present invention become apparent from the sub-claims.

In accordance with the invention, it is thus provided that the combustion chamber has in a center area, relative to the flow direction, a slot extending around the circumference of the combustion chamber wall, said slot dividing the outer combustion chamber wall and the tiles, and through which mixing air can be supplied.

This results in the crucial advantage in accordance with the invention that the NOx emissions can be reduced to the maximum possible extent by the optimized supply of mixing air. It is particularly favourable here that the circumferential slot can be provided with the same effective through-flow surface for mixing in the air as the admixing holes known from the state of the art.

In a particularly favourable embodiment of the invention, it is provided that the combustion chamber is divided by the slot into a front part and a rear part. The expression "front and rear part" always relates here to the direction of flow through the combustion chamber.

The slot provided in accordance with the invention can be designed straight over the circumference, i.e. with a constant width. It is also possible to design it wavy, either with the same width or with variable width. This permits adaptation to the arrangement of the individual burners distributed over the circumference of the annular combustion chamber. In a further design variant, the slot can be provided with a width that changes around the circumference, for example by bulges and constrictions in the circumferential direction.

Since the combustion chamber is divided into a front part and a rear part in accordance with the present invention, it is particularly favourable when the front part and the rear part of the combustion chamber are mounted separately in each case. Mounting is achieved preferably by means of combustion chamber arms. The latter have in a preferred development of the invention through-flow openings in order to optimize the airflow. The cross-sections of the through-flow openings are here preferably larger than the overall cross-section of the slot.

It is understood that the tiles can be mounted on the outer combustion chamber wall in many different ways. It is possible to use stud bolts for this purpose, as is shown by the state of the art. It is however also possible to manufacture the front and rear parts of the combustion chamber wall in one piece in each case by means of additive methods (laser deposition welding method or similar). In any event, it is ensured that a cooling air interspace exists between the tile and the outer combustion chamber wall, in order to provide impingement cooling and effusion cooling in the known manner. The embodiment in accordance with the invention can also be used for combustion chambers of the single-wall design (without tile).

In a particularly favourable development of the invention, it is provided that the front part and the rear part of the combustion chamber wall can change their distance in the event of thermal expansion and thermal contraction. It is thus possible to vary the width of the slot, depending on the temperature of the combustion chamber. Accordingly, the width of the circumferential slot can, due to a greater spacing of the side walls of the slot, be greater in the cold state than in the hot state. Hence the supply of admixing air is increased in the cold state of the combustion chamber, at the same time with reduced cooling air for the combustion chamber walls. In the hot state this is reversed, and the circumferential slot will have a lower width. This permits a marked reduction of the NOx emissions for colder operating points and operating states of the combustion chamber.

Figure 2:
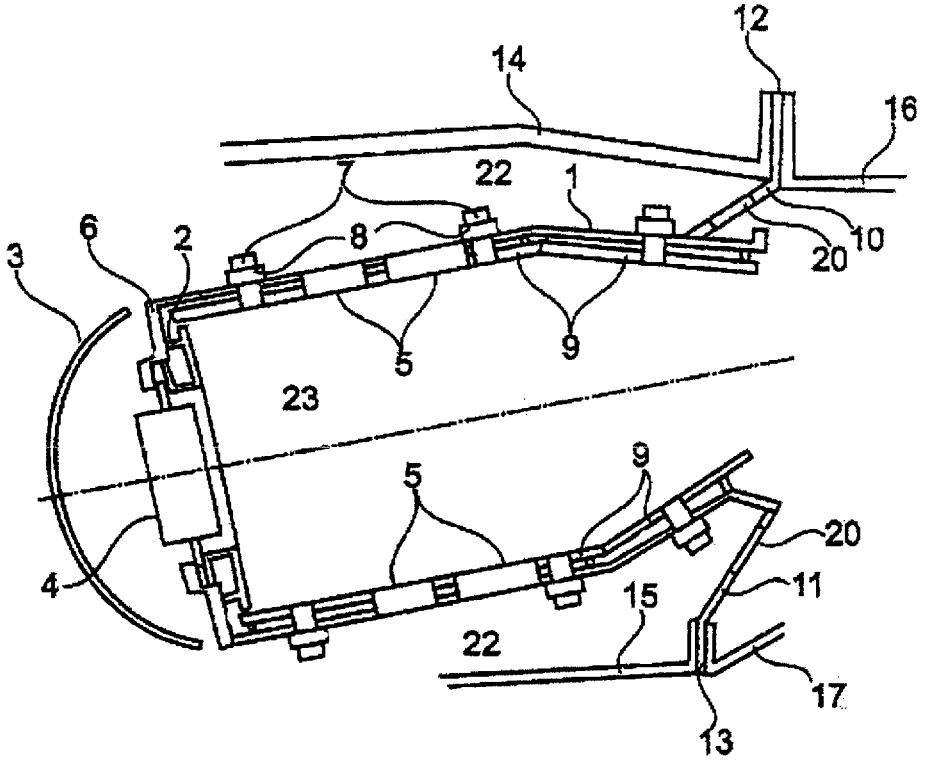
Figure 3:
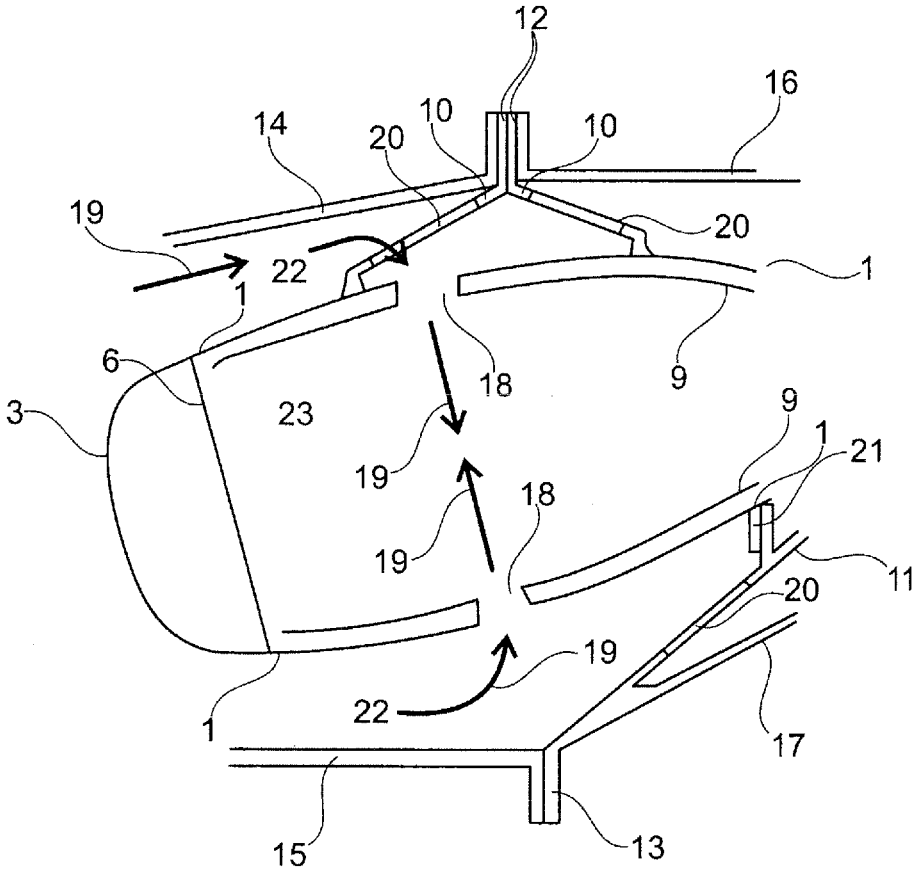
Figure 4:
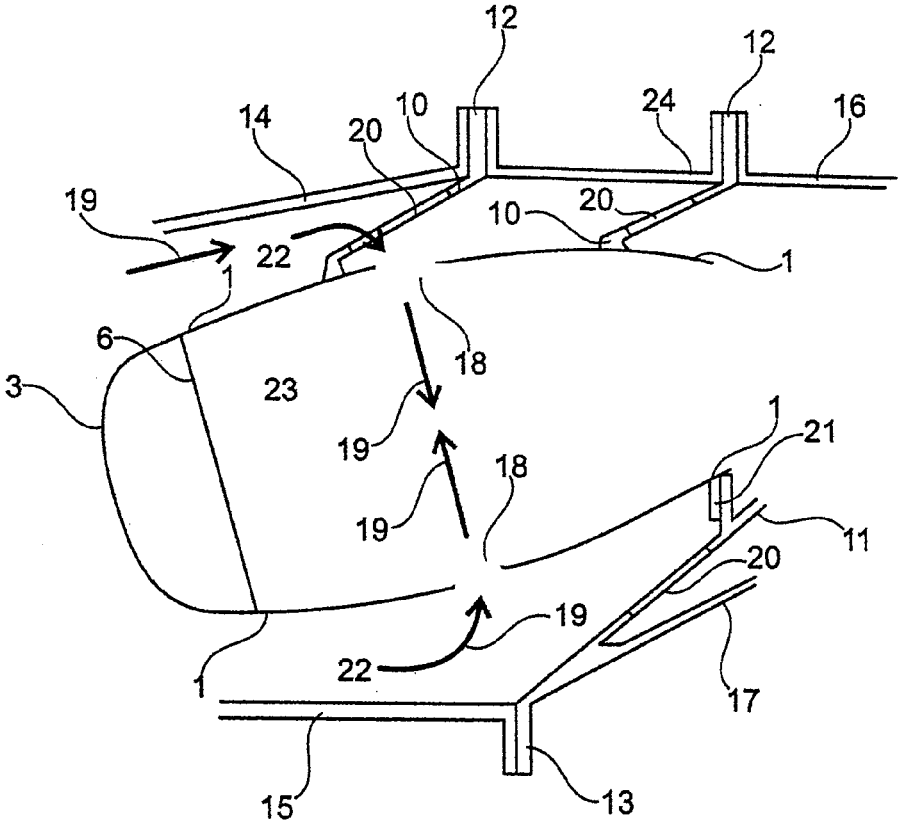
Figure 5:
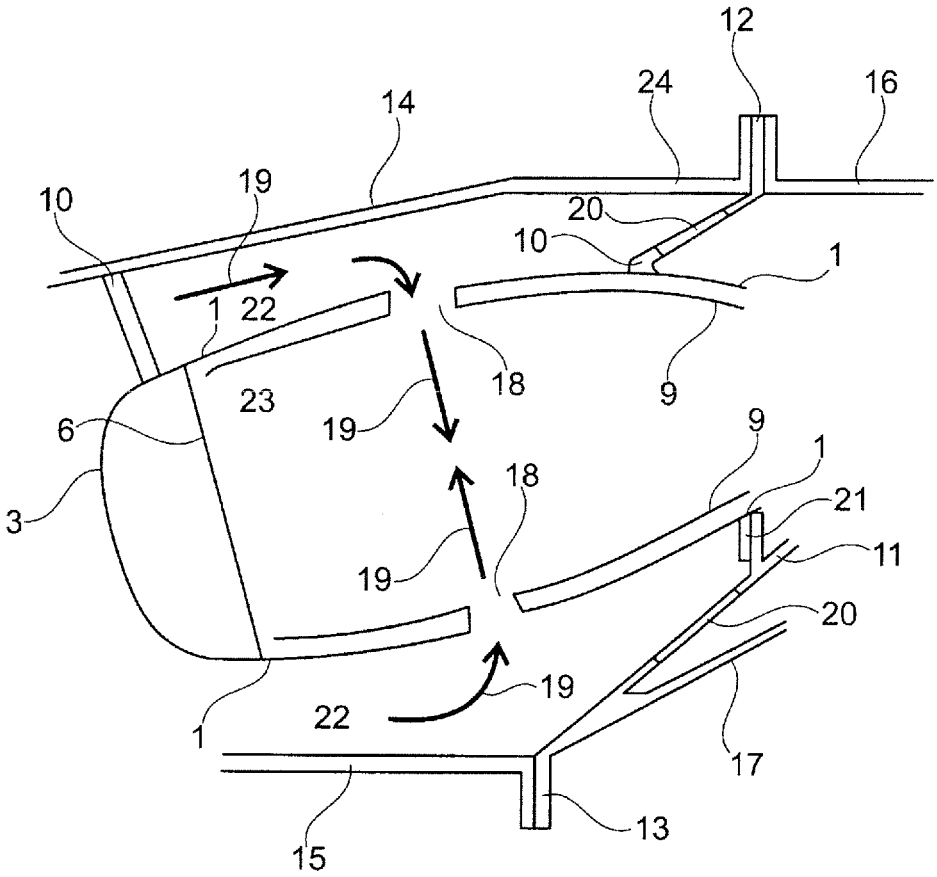
Figure 6:
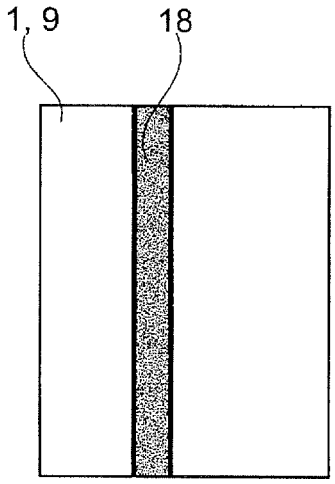
Figure 8:
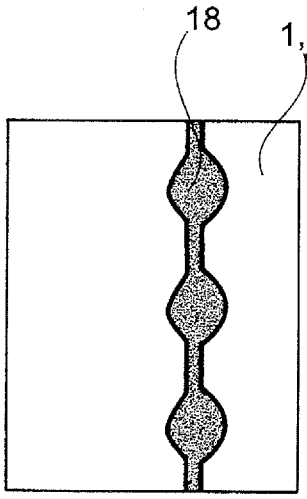
Figure 7:
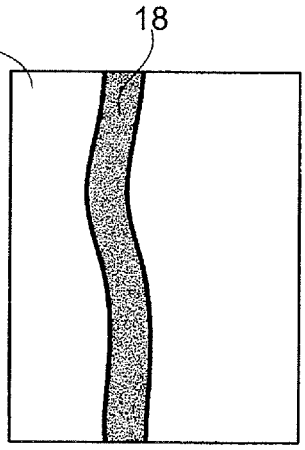
Figure 9:
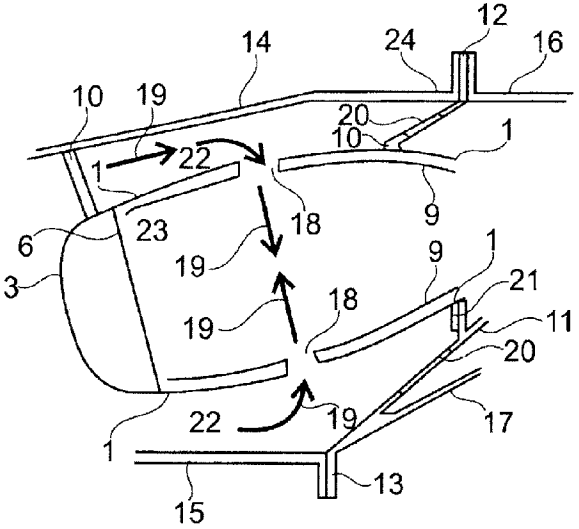
Figure 11:
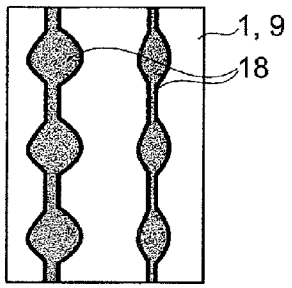
Figure 10:
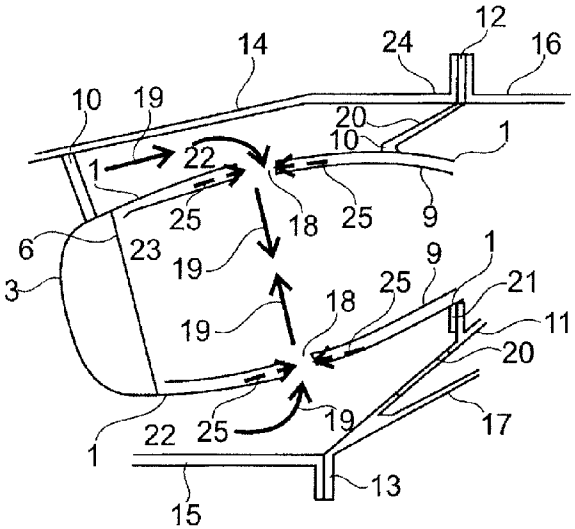
Figure 12:
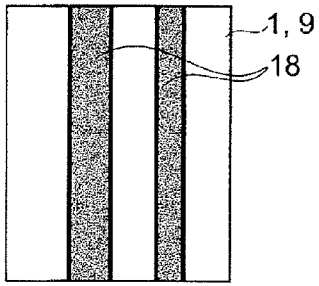
Figure 13:
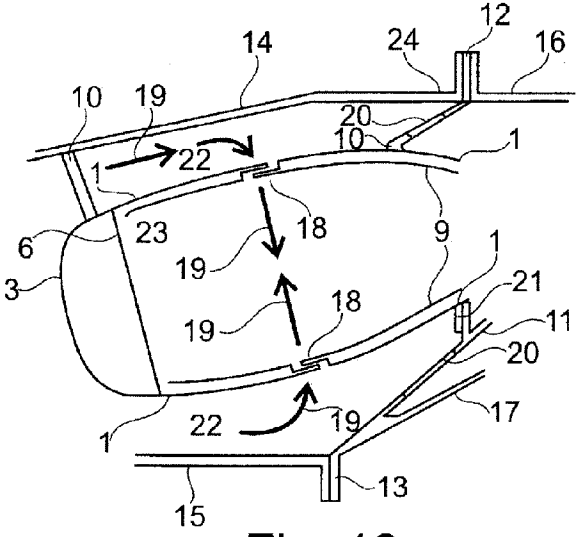
Figure 14:
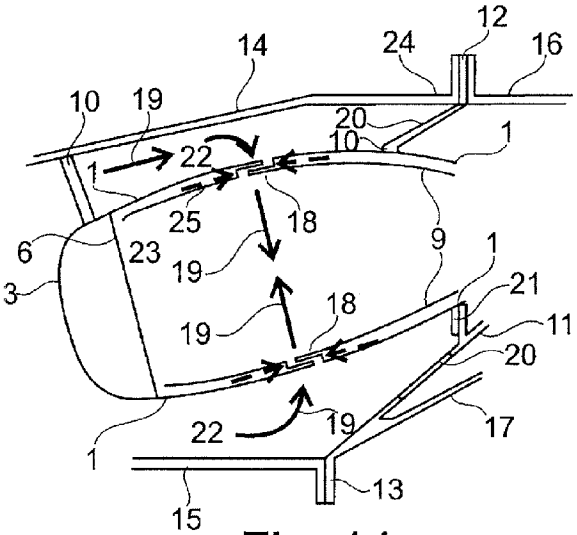

The present invention is described in the following in light of the accompanying drawing showing an exemplary embodiment. In the drawing, FIG. 1 shows a schematic representation of a gas-turbine engine in accordance with the present invention, FIG. 2 shows a simplified sectional side view of a combustion chamber in accordance with the state of the art, FIG. 3 shows a side view, by analogy with FIG. 2, of a first exemplary embodiment of the present invention, FIG. 4 shows a representation, by analogy with FIG. 3, of a second exemplary embodiment of the present invention, FIG. 5 shows a representation, by analogy with FIGS. 3 and 4, of a further exemplary embodiment of the present invention, FIGS. 6 to 8 show schematic representations of the design of the circumferential slot in accordance with the present invention, FIGS. 9 and 10 show views, by analogy with FIG. 5, illustrating a cold and a hot operating state, FIGS. 11 and 12 show representations, by analogy with FIGS. 6 and 8, in the cold and the hot operating state, FIGS. 13 and 14 show design variants, by analogy with FIGS. 9 and 10, and FIGS. 15 and 16 show representations in the hot and cold operating states of the exemplary embodiments of FIGS. 13 and 14, by analogy with FIGS. 11 and 12.

The gas-turbine engine 110 in accordance with FIG. 1 is a generally represented example of a turbomachine where the invention can be used. The engine 110 is of conventional design and includes in the flow direction, one behind the other, an air inlet 111, a fan 112 rotating inside a casing, an intermediate-pressure compressor 113, a high-pressure compressor 114, a combustion chamber 115, a high-pressure turbine 116, an intermediate-pressure turbine 117 and a low-pressure turbine 118 as well as an exhaust nozzle 119, all of which being arranged about an engine center axis 101.

The intermediate-pressure compressor 113 and the high-pressure compressor 114 each include several stages, of which each has an arrangement extending in the circumferential direction of fixed and stationary guide vanes 120, generally referred to as stator vanes and projecting radially inwards from the engine casing 121 in an annular flow duct through the compressors 113, 114. The compressors furthermore have an arrangement of compressor rotor blades 122 which project radially outwards from a rotatable drum or disk 125 linked to hubs 126 of the high-pressure turbine 116 or the intermediate-pressure turbine 117, respectively.

The turbine sections 116, 117, 118 have similar stages, including an arrangement of fixed stator vanes 123 projecting radially inwards from the casing 121 into the annular flow duct through the turbines 116, 117, 118, and a subsequent arrangement of turbine blades 124 projecting outwards from a rotatable hub 126. The compressor drum or compressor disk 125 and the blades 122 arranged thereon, as well as the turbine rotor hub 126 and the turbine rotor blades 124 arranged thereon rotate about the engine center axis 101 during operation.

FIG. 2 shows a combustion chamber in accordance with the state of the art in simplified sectional view. The combustion chamber is provided with a combustion chamber outer wall 1 as well as with a heat shield 2, a combustion chamber head 3 and a burner seal 4. On the inner side of the combustion chamber outer wall 1, tiles 9 are arranged, which are connected in one piece to stud bolts 7, which in turn are secured from the outside by means of nuts 8. The illustration of impingement cooling holes and effusion cooling holes was dispensed with for simplicity's sake.

In the front area the combustion chamber has in a known manner a head plate 6. Several individual and discrete admixing holes 5, through which mixing air is introduced, are provided around the circumference of the combustion chamber in the combustion chamber outer wall 1 and the tiles 9.

Mounting of the combustion chamber is accomplished by means of an outer combustion chamber arm and an inner combustion chamber arm 11 as well as an outer combustion chamber flange 12 and an inner combustion chamber flange 13. The reference numeral 14 identifies an outer combustion chamber casing, while an inner combustion chamber casing is identified with the reference numeral 15. At the outlet of the combustion chamber an outer turbine casing 16 and an inner turbine casing 17 are shown schematically.

FIGS. 3 to 5 each show various design variants of the combustion chamber in accordance with the present invention. In the exemplary embodiment shown in FIG. 3 it is in particular clearly discernible that the combustion chamber is divided into a front part and a rear part. The division is achieved by an admixing slot 18 extending in the circumferential direction and passing through both the combustion chamber outer wall 1 and the tile 9. It is thus possible to supply admixing air 19 evenly and effectively, as shown by the arrows. With a single-wall design of the combustion chamber consisting only of the combustion chamber outer wall 1 without tile, the admixing slot 18 separates the combustion chamber wall in similar manner into a front half and a rear half.

The combustion chamber shown in FIG. 3 is mounted at its front part and its rear part by means of separate outer combustion chamber arms 10 in each case. Said arms have through-flow openings 20 to ensure an optimized guidance of the cooling air. The two outer combustion chamber arms 10 are fastened by their outer combustion chamber flanges 12 to the outer combustion chamber casing 14 and to the outer turbine casing 16. The inner fastening is achieved in similar manner to the embodiment known from the state of the art, where there is additionally a connection 21 between the combustion chamber and the inner combustion chamber arm 11.

The design variant of FIG. 4 differs in respect of the mounting on the outer combustion chamber casing 14 and on the outer turbine casing 16. The two outer combustion chamber flanges 12 are fastened by means of an intermediate casing 24. This embodiment also shows a single wall combustion chamber wall variation.

In the exemplary embodiment shown in FIG. 5, the rear part of the combustion chamber with its outer combustion chamber flange 12 is mounted between the intermediate casing 24 and the outer turbine casing 16, while the front part of the combustion chamber is mounted using the combustion chamber head 3 and an outer combustion chamber arm 10.

FIGS. 6 to 8 show in a schematic view design variants of the admixing slot 18. FIG. 6 shows a design variant in which the admixing slot 18 is designed straight with a constant width. In accordance with FIG. 7, a constant width of the admixing slot 18 is provided. Said slot is however designed wavy around the circumference. FIG. 8 shows a design variant of the admixing slot 18, in which the latter has wider areas and narrower areas around the circumference.

FIGS. 9 to 12 show a particularly preferred development of the invention in analogous representation to FIG. 5. FIG. 9 here shows a cold or colder operating state, while FIG. 10 shows a hot operating state. In the cold operating state there is a greater width of the admixing slot 18, as is shown in FIGS. 11 and 12 by analogy with the embodiments of FIGS. 8 and 6 in the left-hand half of the illustration. At increased temperature (hot operating state), the parts of the combustion chamber expand, as is shown by the arrows 25. As a result the width of the admixing slot 18 is reduced. This is shown in comparison in FIGS. 11 and 12 in the right-hand half. It is thus possible in the cold operating state to supply a larger mixing air volume in order to reduce the NOx emissions for colder operating points.

Figure 15:
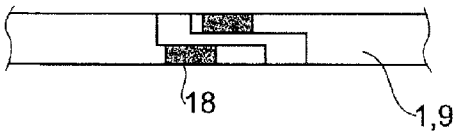
Figure 16:
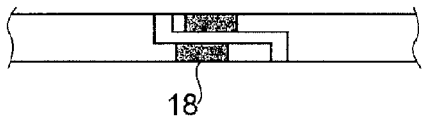

FIGS. 13 and 14 show simplified sectional views in analogous representation to FIGS. 9 and 10. In a variation from the exemplary embodiment in FIGS. 9 and 10, in which the edges of the admixing slot 18 are designed straight and arranged directly opposite one another, the exemplary embodiment of FIGS. 13 and 14 shows a design in which the walls of the partial areas of the combustion chamber overlap, as is shown in FIGS. 15 and 16. The two overlapping areas are each provided with a slot or with holes. Due to this overlap there is in the cold state (FIG. 15) a smaller overlap, resulting in a lower overall width of the admixing slot 18. In a hot operating state (FIG. 16) the overlap is larger, as can be seen from the upper half of FIG. 16. This results in a wider effective admixing slot 18. In this exemplary embodiment too, the slot geometry can be designed in the circumferential direction straight or wavy or with a changing cross-section. FIGS. 13 to 16 thus show an exemplary embodiment which acts in the opposite way to the exemplary embodiment of FIGS. 9 to 12, since the width of the admixing slot widens from the cold to the hot operating state.

The invention thus permits an ideal blocking/mixing of the admixing air 19 with the combustion gases in the combustion chamber volume 23. The admixing air is supplied in optimum manner through the circumferential slot 18, which is provided in the combustion chamber wall 1 and the tile 9, so that the NOx emissions are minimized. The circumferential slot has preferably the same effective flow cross-section same through-flow surface as comparable admixing holes 5 in accordance with the state of the art (see FIG. 2).

As described, the combustion chamber in accordance with the invention is split into two parts. A suspension concept is therefore described in accordance with the invention in which the parts of the combustion chamber are fastened to the inner and outer combustion chamber casing and to the turbine casing in a suitable manner. This is achieved, as explained, by additional combustion chamber arms 12. The latter can be fastened in any way to the combustion chamber or be connected thereto, for example by a one-piece design, by welding, by bolting or in similar manner.

LIST OF REFERENCE NUMERALS

1 Combustion chamber outer wall
2 Heat shield
3 Combustion chamber head
4 Burner seal
5 Admixing holes
6 Head plate
7 Stud bolt
8 Nut
9 Tile
10 Outer combustion chamber arm
11 Inner combustion chamber arm
12 Outer combustion chamber flange
13 Inner combustion chamber flange
14 Outer combustion chamber casing
15 Inner combustion chamber casing
16 Outer turbine casing
17 Inner turbine casing
18 Admixing slot
19 Admixing air
20 Through-flow openings
21 Connection combustion chamber—inner combustion chamber arm 11
22 Annular space of combustion chamber
23 Combustion chamber volume
24 Intermediate casing
25 Expansion
101 Engine center axis
110 Gas-turbine engine/core engine
111 Air inlet
112 Fan
113 Intermediate-pressure compressor (compressor)
114 High-pressure compressor
115 Combustion chamber
116 High-pressure turbine
117 Intermediate-pressure turbine
118 Low-pressure turbine
119 Exhaust nozzle
120 Guide vanes
121 Engine casing
122 Compressor rotor blades
123 Stator vanes
124 Turbine blades
125 Compressor drum or disk
126 Turbine rotor hub
127 Exhaust cone

What is claimed is:

1. A combustion chamber of a gas turbine comprising:

an outer combustion chamber wall;

tiles attached to an inner side of the outer combustion chamber wall;

a slot positioned in a center area of the combustion chamber relative to a flow direction and extending around an entire circumference of the combustion chamber, the slot physically separating the outer combustion chamber wall and the tiles into a front part and a separate rear part for supplying mixing air, the front part and the rear part being separately mounted to the gas turbine, the slot including an outlet, the outlet opening toward a radial center of the combustion chamber, a flow path of the slot at the outlet being directed toward the radial center of the combustion chamber to direct the mixing air from the outlet toward the radial center of the combustion chamber;

a plurality of combustion chamber arms separately mounting the front part of the combustion chamber and the rear part of the combustion chamber, the combustion chamber arms having through-flow openings, wherein a through-flow opening most adjacent to a combustion chamber head provides the slot with at least a portion of the mixing air.

2. The combustion chamber in accordance with claim 1, wherein the slot is shaped as at least one chosen from straight, wavy and having a varying cross-section around the circumference.

3. The combustion chamber in accordance with claim 1, and further comprising a front combustion chamber arm for mounting the front part and a rear combustion chamber arm for mounting the rear part, the front part and the rear part attached to the front combustion chamber arm and rear combustion chamber arm respectively to vary a cross-sectional flow area at an exit of the slot due to thermal expansion or contraction.

4. The combustion chamber in accordance with claim 3, wherein the cross-section flow area of the slot is variable.

5. A combustion chamber of a gas turbine comprising:

A single wall combustion chamber;

a slot positioned in a center area of the combustion chamber relative to a flow direction and extending around an entire circumference of the combustion chamber, the slot physically separating the outer combustion chamber wall into a front part and a separate rear part for supplying mixing air, the front part and the rear part being separately mounted to the gas turbine, the slot including an outlet, the outlet opening toward a radial center of the combustion chamber, a flow path of the slot at the outlet being directed toward the radial center of the combustion chamber to direct the mixing air from the outlet toward the radial center of the combustion chamber;

a plurality of combustion chamber arms separately mounting the front part of the combustion chamber and the rear part of the combustion chamber, the combustion chamber arms having through-flow openings, wherein a through-flow opening most adjacent to a combustion chamber head provides the slot with at least a portion of the mixing air.

6. The combustion chamber in accordance with claim 5, wherein the slot is shaped as at least one chosen from straight, wavy and having a varying cross-section around the circumference.

7. The combustion chamber in accordance with claim 5, and further comprising a front combustion chamber arm for mounting the front part and a rear combustion chamber arm for mounting the rear part, the front part and the rear part attached to the front combustion chamber arm and rear combustion chamber arm respectively to vary a cross-sectional flow area at an exit of the slot due to thermal expansion or contraction.

8. The combustion chamber in accordance with claim 7, wherein the cross-section flow area of the slot is variable.

* * * * *